US006382439B1

(12) United States Patent
Belokin et al.

(10) Patent No.: US 6,382,439 B1
(45) Date of Patent: May 7, 2002

(54) BOTTLE CONNECTOR

(76) Inventors: Paul Belokin; Martin P. Belokin, both of 7801 I-35 North, Denton, TX (US) 76202; Norman P. Belokin, 1606 Oak Ridge Dr., Corinth, TX (US) 76205

( * ) Notice: Subject to any disclaimer, the term of this patent is extended or adjusted under 35 U.S.C. 154(b) by 0 days.

(21) Appl. No.: 09/322,043

(22) Filed: May 28, 1999

(51) Int. Cl.[7] ..... B65D 51/00; B65D 21/02

(52) U.S. Cl. ..... 215/228; 206/459.5; 215/386; 220/23.86; 482/106

(58) Field of Search ..... 215/6, 10, 228, 215/274, 276, 329, 252, 23.86; 220/288, 212, 23.2, 23.4, 23.83, 23.86, 386; 206/459.5; 285/355, 390; 141/364, 319; 482/106, 108

(56) References Cited

U.S. PATENT DOCUMENTS

| | | | | | |
|---|---|---|---|---|---|
| 1,961,033 | A | * | 5/1934 | Bicks | 215/45 |
| 2,043,226 | A | * | 6/1936 | Beider et al. | 214/44 X |
| 2,110,237 | A | * | 3/1938 | Parsons | 215/6 X |
| 2,196,345 | A | * | 4/1940 | Taylor | 215/334 |
| 2,546,095 | A | * | 3/1951 | Gustlin | 601/121 |
| 2,562,496 | A | * | 7/1951 | Kirsch | 215/10 X |
| 2,616,593 | A | * | 11/1952 | Leibenhaut | 215/43 X |
| 2,884,148 | A | * | 4/1959 | Schneider et al. | 215/6 |
| 3,054,535 | A | * | 9/1962 | Clarey | 215/44 X |
| 3,245,701 | A | * | 4/1966 | Leopold, Sr. et al. | 285/355 X |
| 3,449,210 | A | * | 6/1969 | Rohde | 215/44 X |
| 3,620,267 | A | * | 11/1971 | Seablom | 141/24 |
| 3,877,499 | A | * | 4/1975 | Fluster | 141/310 |
| 4,006,837 | A | * | 2/1977 | Gates et al. | 215/340 |
| 4,157,144 | A | * | 6/1979 | Weiler et al. | 215/252 |
| 4,313,477 | A | * | 2/1982 | Sebalos | 141/301 |
| 4,322,012 | A | * | 3/1982 | Conti | 215/252 X |
| 4,336,891 | A | * | 6/1982 | Smith | 215/276 |
| 4,347,879 | A | * | 9/1982 | Blaser | 141/364 |
| 4,712,815 | A | * | 12/1987 | Reeves | 285/334 |
| 4,747,501 | A | * | 5/1988 | Greaves | 215/228 X |
| 4,919,285 | A | * | 3/1990 | Roof et al. | 215/252 X |
| 4,942,432 | A | * | 7/1990 | Mort et al. | 399/106 |
| 4,946,034 | A | * | 8/1990 | Matsubara | 206/459.5 X |
| 5,145,078 | A | * | 9/1992 | Hannon et al. | 215/252 |
| 5,251,942 | A | * | 10/1993 | Whaley | 285/355 |
| 5,379,909 | A | * | 1/1995 | Roark | 215/10 X |
| 5,441,471 | A | * | 8/1995 | Passer | 482/106 |
| 5,474,209 | A | * | 12/1995 | Mas et al. | 222/83 |
| 5,918,650 | A | * | 7/1999 | Borden | 141/383 |
| 6,129,687 | A | * | 10/2000 | Powell et al. | 220/666 |

FOREIGN PATENT DOCUMENTS

| | | | | |
|---|---|---|---|---|
| CA | 742535 | * | 9/1966 | 215/43 |
| GB | 5593 | * | 3/1897 | 215/44 |

* cited by examiner

*Primary Examiner*—Allan N. Shoap
*Assistant Examiner*—Joseph C. Merek
(74) *Attorney, Agent, or Firm*—Jack A. Kanz

(57) ABSTRACT

The mouth ends of two bottles are connected in an opposed relationship by an axially elongated connector which has a cavity formed on each end. The cavities are internally threaded to accommodate the external threads on the necks of the bottles and securely connect the bottles together in a rigid dumbbell arrangement with a hand-grip size connection between the bottles.

10 Claims, 2 Drawing Sheets

BOTTLE CONNECTOR

BOTTLE CONNECTOR

This invention relates to exercise apparatus. More particularly, it relates to devices for connecting the necks and closing the mouths of opposed containers such as bottles and the like to form barbell or dumbbell weights rigidly interconnected by a hand-sized bar grip.

Because of the popularity of soft drinks, bottled water, prepared juices and the like, millions of bottle-like containers are sold daily. While many bottles are made of recyclable materials, the majority of such bottles are discarded and eventually find their way into non-regenerating disposals such as landfills and the like. Because of the wide variety of liquid goods sold in such containers, a large collection of various sizes and shapes of bottles may be found in most households. Unless an active recycle or other disposal program is maintained, accumulation of such empty bottles can become a nuisance.

The present invention provides a connector and bar grip which closes the mouth ends of opposed bottles and joins the opposed bottles to form a rigid dumbbell-shaped structure. In the preferred embodiment, the coupling device comprises an axially elongated body with diametrically opposed cavities in the ends thereof. Each cavity contains internal threads adapted to mate with the externally threaded neck of a bottle. The threads and the cavity are designed so that when the bottle neck is inserted into the cavity, the mouth of the bottle is sealed and a face on the connector mates with or abuts a radially extending flange on the neck of the bottle to provide rigid connection and support for the bottle. The bottles may be filled or partially filled with liquid (such as water) or solids (such as sand) to provide any desired weight. The connector is shaped and sized to provide a comfortable hand grip so that the connected bottles may be used as a free-weight barbell for repetitive weight-lifting exercises. Since bottles of almost any desired shape and size are generally found in most households as waste products, and since the bottles may be filled (or partially filled) with readily available (and easily disposable) weight such as water, sand or the like, the connector of the invention provides a convenient, inexpensive and easily transportable and/or storable device for forming exercise weights from readily available and disposable materials. Other features and advantages of the invention will become more readily understood from the following description taken in connection with the appended claims and attached drawing in which:

Figure 1:
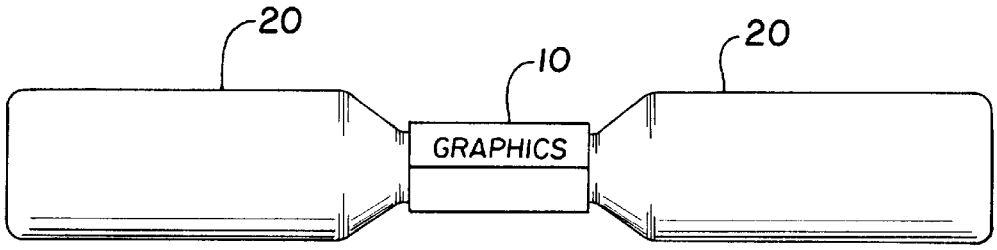
FIG. 1 is a front elevational view of a dumbbell-like weight formed by connecting two bottles according to the invention.

The drawing is incorporated into and forms part of the specification to illustrate exemplary embodiments of the invention. For clarity of illustration, like numerals designate corresponding parts throughout the drawing. It will be recognized that the principles of the invention may be utilized and embodied in many and various forms. In order to demonstrate these principles, the invention is described herein by reference to specific embodiments. The invention, however, is not limited to the specific forms illustrated and described.

As illustrated in the drawing an axially elongated substantially cylindrical connector 10 mates with and interconnects the necks 21 of opposed bottles 20. While bottles 20 are illustrated as elongated cylindrical containers, it will be readily recognized that bottles of any shape or size may be used. However, to be used in accordance with the invention each bottle 20 must have threads 22 on the external surface of the neck 21 and a radially extending flange or collar 25 intermediate the threads 22 and the main body of the bottle 20.

Figure 4:
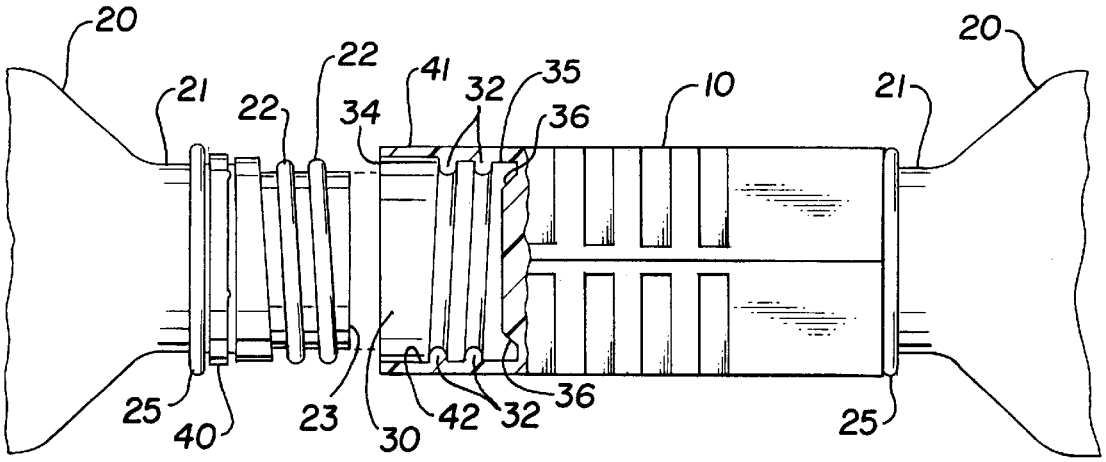
FIG. 4 partially exploded and partially sectional view of an assembly of bottles connected with the connector of FIG. 3.

In modern manufacturing processes for plastic bottles the entire bottle is formed by expanding softened plastic material into a mold. The neck portion 21 is usually thicker and heavier because it must be sufficiently rigid to be closed by a screw cap. Flange 25 is formed on the neck during manufacturing and used for many purposes. In some cases the flange 25 is used to support safety seals or the like. The flange 25 is also commonly used to support the bottle in carry packages or in dispensing racks. Because of these and for various other reasons, most plastic bottles include a flange 25 substantially as illustrated in FIGS. 2 and 4.

In accordance with the preferred embodiment of the invention the connector 10 is a solid rigid substantially cylindrical body with diametrically opposed open cavities 30 in the ends thereof. Each cavity includes a set of internal threads 32 which are adapted to mate with the external threads 22 on the bottle necks 21.

Figure 2:
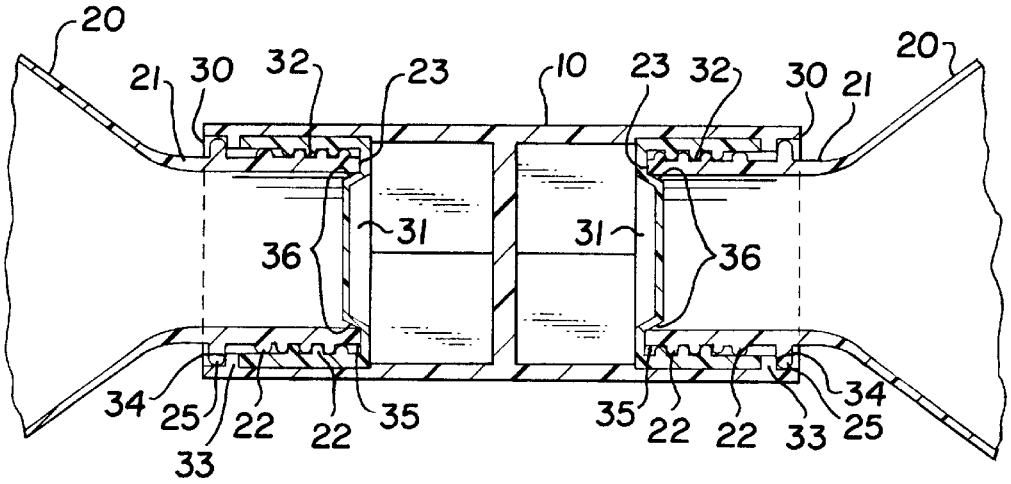
FIG. 2 is a sectional view of the connector device of FIG. 1.

In the embodiment illustrated in FIG. 2, an annular face 34 on an inwardly projecting annular flange 33 is positioned within the cavity 30 so that the collar 25 is urged firmly against the annular face 34 when the threaded portion of neck 21 is fully inserted into the cavity 30 in order to provide rigid support for the bottle neck. The annular face 34 is the outer face of an inwardly projecting annular flange 33 and displaced within the cavity 30 a sufficient distance so that flange 25 is drawn within the cavity 30 and trapped within the cavity walls. Annular face 34 may, however, be formed by the end face of the connector 10.

To further insure that the mouth of the bottle is sealed and to aid in rigidly securing the neck 21 of each bottle 20 within cavity 30, the end face 23 of the neck which defines the mouth is forced into an annular groove 35 which circumscribes the base of the cavity. In the preferred embodiment the wall 36 which defines the inner diameter of the groove 35 is tapered inwardly so that the width of the base of the groove 35 is less than the thickness of the end face 23 of the neck but the entrance to the groove is somewhat larger. Accordingly, as the threaded neck 21 is screwed into the cavity 30 the inner wall 36 of the annular groove 35 is wedged into the mouth of the bottle and acts both as a plug to seal the mouth of the bottle and as a reinforcing wedge which rigidly and securely traps the neck end of the bottle within the cavity 30.

It will be readily appreciated that dimensions such as the size of the bottle neck mouth, the size of the neck, the size and type of threads, the shape and size of the collar 25, etc., will depend on dimensions set by the original user of the bottle. However, most plastic bottles employ one of only a few standard sizes and shapes. Thus the connector of the invention may be manufactured in only a few different sizes and accommodate a large portion of the various bottle sizes available.

The connector 10 may be made by any of various conventional manufacturing processes from any of a wide variety of materials. For example, it may be machined from metal, wood or rigid plastic stock. The connector 10 may, of course, be molded or otherwise formed from liquid or powdered materials such as nylon, thermosetting plastics, etc. Obviously, the cavities 30 with threads 22, etc., may be machined or otherwise cut into bulk material or formed by cutting, molding, etc.

In the embodiment illustrated in FIG. 2 the connector 10 is formed by molding a main body 10 with an unthreaded cavity 30 in each end. A cap 31 which carries internal threads 32 is forced into the cavity 30 and trapped therein by annular flange 33. To insure rigidity, the cap 31 may be glued or otherwise secured in the cavity 30. By forming the connector 10 with unthreaded cavities as shown in FIG. 2, a single size or model of connector body may be fitted with any of a plurality of selected sizes and shapes of caps as desired.

Figure 3:
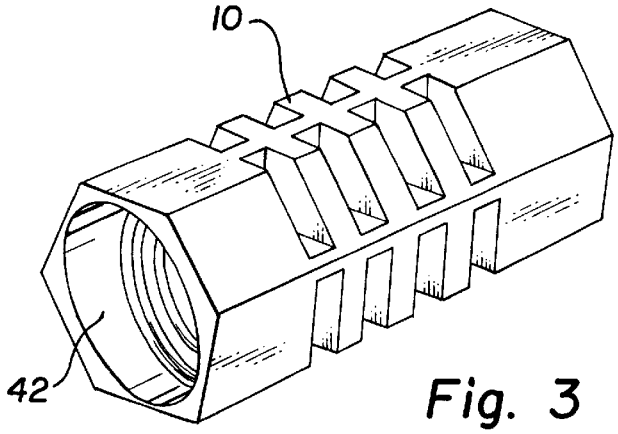
FIG. 3 is a perspective view of an alternative embodiment of connector for connecting bottles in accordance with the invention.

In the embodiment illustrated in FIGS. 3 and 4 the connector 10 is a monolithic body and threads 32 and groove 35 are formed as part of the cavity 30. This embodiment, however, is particularly adapted to accommodate bottles on which the breakaway ring portion of a breakaway safety cap remains on the neck of the bottle.

In many instances bottles (as purchased) containing beverages and the like are closed with screw-on caps which in include a breakaway safety seal. Such caps comprise a conventional screw-on cap attached to a breakaway ring 40. The breakaway ring 40 is usually formed as part of the cap but has an internal diameter which is less than the outer diameter of the threads 22 on the neck 21 of the bottle 20. The breakaway ring 40 thus is trapped on the neck 21 between threads 22 and collar 25. The breakaway ring 40 is separable from the cap and the connection therebetween must be broken to remove the cap. The purpose of the breakaway ring 40 is to prevent unintended removal of the cap and, since it must be severed from the cap to permit removal of the cap, severance of the breakaway ring from the cap indicates that the sealed container has been opened. However, since the breakaway ring 40 remains trapped between the threads 22 and the collar 25, and since the ring 40 is not otherwise attached to the bottle, the ring 40 may interfere with forming a rigid coupling with connector 10. To avoid this problem, cavity 30 of the connector 10 shown in FIG. 4 includes an annular skirt 41 which extends from the internal threads 32 to position the annular face 34 defined by the end of the connector 10 at a distance removed from threads 22. The internal diameter of the skirt 41 is greater than the outer diameter of the breakaway ring 40 but less than the diameter of collar 25. The skirt 41 thus defines an enlarged cavity 42 which encompasses the breakaway ring 40 and permits annular end face 34 to abut flange 25 to form a rigid reinforced coupling as discussed above.

The exterior of the connector 10 may take any desired shape and have any desired finish. For example, the external surface may be simply cylindrical and smooth. In the preferred embodiment, however, the body is hexagonal in cross section and thus has six substantially flat faces on which instructional information, advertising or other graphics may be displayed as illustrated in FIG. 1.

While the invention has been described with particular reference to joining two bottles containing weighty materials to form exercise apparatus, it will be readily recognized that the same principles may be used to interconnect two evacuated bottles to form a float or the like. Various other uses for bottles or other containers joined in diametrically opposed relationship will become apparent to those skilled in the art.

From the foregoing it will be recognized that the principles of the invention may be employed in various arrangements to obtain the benefit of the many advantages and features disclosed. It is to be understood, therefore, that even though numerous characteristics and advantages of the invention have been set forth together with details of the structure and function of the invention, this disclosure is to be considered illustrative only. Various changes and modifications may be made in detail, especially in matters of size, shape and arrangements of parts, without departing from the spirit and scope of the invention as defined by the appended claims.

What is claimed:

1. A combination comprising:

(a) first and second containers, each having a body, an externally threaded neck which defines an open mouth, and a collar extending radially from said neck intermediate the threaded portion of the neck and the body of said container which defines a diameter greater than the diameter of the neck portions adjacent thereto; and (b) a coupling comprising an axially elongated body with a central divider forming diametrically opposed cavities in the ends thereof, each cavity supporting internal threads mating with the externally threaded neck on one of said first and second containers and an end face which abuts the radially extending collar.

2. A combination as defined in claim 1 wherein at least one of said containers includes a breakaway ring on its neck between the external threads and the radially extending collar; said breakaway ring is enclosed within one of said cavities; and the end face of the connector surrounding that cavity abuts the radially extending collar on such container.

3. A combination as defined in claim 1 wherein said end face is on a flange which projects radially inwardly from the inner wall of the cavity and the collar mates with said end face and the inner wall of the cavity.

4. A combination as defined in claim 1 including an annular groove circumscribing the base of said cavity with an inwardly projecting inner wall which is wedged into the mouth of the neck of said container to sealingly close the said mouth.

5. A combination as defined in claim 1 wherein said internal threads are on the internal surface of a cap secured within said cavity.

6. A combination as defined in claim 5 wherein said end face which abuts the radially extending collar is the open end face of said cap.

7. A combination as defined in claim 5 wherein said cap is at least partially secured in said cavity by an annular flange projecting inwardly from the internal wall of said cavity.

8. A combination as defined in claim 1 wherein the outer surface of said axially elongated body displays graphics.

9. A combination as defined in claim 1 wherein said axially elongated body is hexagonal in cross section.

10. A combination comprising:

(a) first and second containers, each having a body with an externally threaded neck which defines an open mouth and a radially extending collar intermediate the threaded portion of the neck and the body of said container; and (b) a coupling comprising an axially elongated body with a central divider forming diametrically opposed cavities in the ends thereof, each cavity supporting internal threads mating with the externally threaded neck on one of said first and second containers and an end face which abuts the radially extending collar; wherein said end face is on a flange which projects radially inwardly from the inner wall of the cavity and the collar mates with said end face and the inner wall of the cavity.

* * * * *